United States Patent [19]

Van Leeuwen

[11] Patent Number: 4,972,993

[45] Date of Patent: Nov. 27, 1990

[54] VANDAL-PROOF OSCILLATING IRRIGATION SPRINKLER

[75] Inventor: Timothy O. Van Leeuwen, Gardnerville, Nev.

[73] Assignee: GardenAmerica Corporation, Carson City, Nev.

[21] Appl. No.: 335,694

[22] Filed: Apr. 10, 1989

[51] Int. Cl.[5] ..... B05B 3/04

[52] U.S. Cl. ..... 239/206; 239/242

[58] Field of Search ..... 239/240–242, 239/DIG. 1, 206

[56] References Cited

U.S. PATENT DOCUMENTS

| | | | |
|---|---|---|---|
| 3,107,056 | 10/1963 | Hunter | 239/206 |
| 3,854,664 | 12/1974 | Hunter | 239/206 |
| 4,253,605 | 3/1981 | Hunter | 239/206 |
| 4,417,691 | 11/1983 | Lockwood | 239/DIG. 1 X |
| 4,625,914 | 12/1986 | Sexton et al. | 239/206 |
| 4,650,118 | 3/1987 | Saarem | 239/206 |
| 4,787,558 | 11/1988 | Benton et al. | 239/241 X |

*Primary Examiner*—Andres Kashnikow
*Assistant Examiner*—Kevin P. Weldon
*Attorney, Agent, or Firm*—Barry E. Deutsch; J. Bruce Hoofnagle

[57] ABSTRACT

An irrigation sprinkler which may include a pop-up assembly driven by a water-flow powered motor. A nozzle is mounted on the upper end of the pop-up assembly and is rotated through an adjustable arc to irrigate a sector of a particular size, and it is automatically reversed at the end points of the selected irrigated sector to oscillate back and forth across the sector. The sprinkler is constructed so that if the pop-up assembly is rotated forceably beyond its preset arc of coverage, either by vandals or others, the sprinkler itself is not damaged, but it will automatically reset itself into its previously preset arc of coverage.

7 Claims, 3 Drawing Sheets

VANDAL-PROOF OSCILLATING IRRIGATION SPRINKLER

BACKGROUND OF THE INVENTION

Sprinkler heads with rotatable pop-up nozzles propelled by internal water pressure are presently in widespread use. These heads are capable of discharging relatively large volumes of water over large areas of land to be irrigated. Many types of self-propelled rotatable sprinklers are known to the art.

One type of irrigation sprinkler, for example, includes a pop-up assembly which is caused to extend up through the cap of the housing against internal spring force by internal water pressure. The pop-up assembly is driven by an internal water-powered motor to turn back and forth over a pre-set arc. A nozzle is mounted on the upper end of the poppet assembly to be turned through the pre-set arc in order to irrigate a sector of the land being watered. This particular type of irrigation sprinkler is described, for example, in U.S. Pat. No. 4,650,118 which is assigned to the present Assignee.

The present invention is concerned with a sprinkler which may be similar to the sprinkler described in the preceding paragraph, or other type, which has been modified to render it effectively proof against damage due to forceable turning of the poppet assembly with respect to the housing, by vandals or others.

The sprinkler described in U.S. Pat. No. 4,650,118 is constructed so that when the pop-up assembly is turned by the internal water-powered motor in a first direction to one end of a preset arc, a trip tab on the pop-up assembly engages a shifter and moves the shifter a small angular increment. This movement of the shifter causes the internal mechanism of the sprinkler to reverse so that the pop-up assembly is then rotated in the opposite direction to the other end of its preset arc at which a second trip tab engages the shifter to cause the pop-up assembly to reverse and again turn in its first direction.

A problem encountered in irrigation sprinklers of the type described above, is that should the pop-up assembly be forced past its trip points, either by vandals or by others, there is a tendency for the trip tabs to break.

A feature of the irrigation sprinkler of the present invention is that the sprinkler is constructed so that should the turning assembly be forceably turned past the trip point in either direction, an axially resilient member on the shifter will be depressed before the engaging trip tab breaks. The drive of the sprinkler then forces the trip tab up and over the resilient member, and when the tab has passed the member, the member will return to its original position without damage. The turning assembly will then be driven over the resilient member of the shifter is shaped so that the tab will pass over it without moving the shifter. Accordingly, the sprinkler will automatically reset to its original arc of coverage.

DETAILED DESCRIPTION OF THE ILLUSTRATED EMBODIMENT

Figure 1:
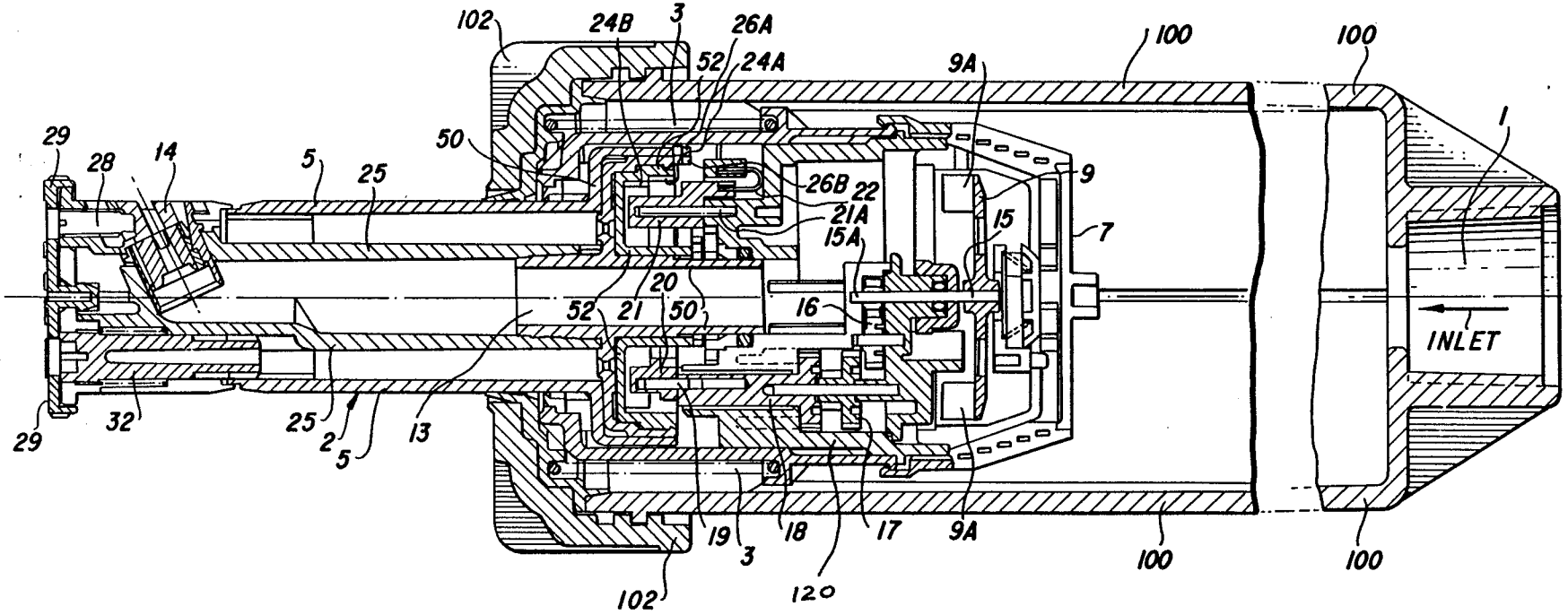
FIG. 1 is a side sectional view of a sprinkler head constructed in accordance with the present invention in one of its embodiments.

The irrigation sprinkler assembly shown in FIG. 1, for example, includes a tubular housing 100 having an inlet 1 at one end through which water under pressure is introduced into the interior of the housing. A pop-up assembly designated generally as 2 is coaxially mounted within the tubular housing for axial movement within the housing from a retracted position to an operational position (shown in FIG. 1) in which the pop-up assembly protrudes through a central opening in a cap 102 mounted on the other end of housing 100. The pop-up assembly is spring-biased to its retracted position by a spring 3, and it is forced into its illustrated operational position by water pressure introduced into the housing 100 through inlet 1. The pop-up assembly 2 includes an outer tubular riser 5 and a coaxial inner tubular riser assembly 25.

A water-driven motor including a rotor 9 is mounted on the inner end of the pop-up assembly. Water is introduced into the motor through a screen filter 7, and the water passes through the motor and through an internal axial passage 13 in the inner tubular riser assembly 25 to a nozzle assembly 14 mounted on the upper end of the inner riser assembly. A cap 29 is mounted on the upper end of the inner riser assembly 25 by snap fit coaxially with the central axis of the sprinkler.

Rotor 9 of the motor is coupled through a drive shaft 15 to a pinion 15A. Pinion 15A drives an idler gear 16 which, in turn, drives an output shaft 18 through a series of reduction gears 17. The rotor 9 has a series of rotor blades 9A against which the incoming water pressure is directed and which cause the rotor to rotate. The output shaft drives an axial eccentric pin 19 which operates a pawl 20, shown in FIG. 2.

Figure 2:
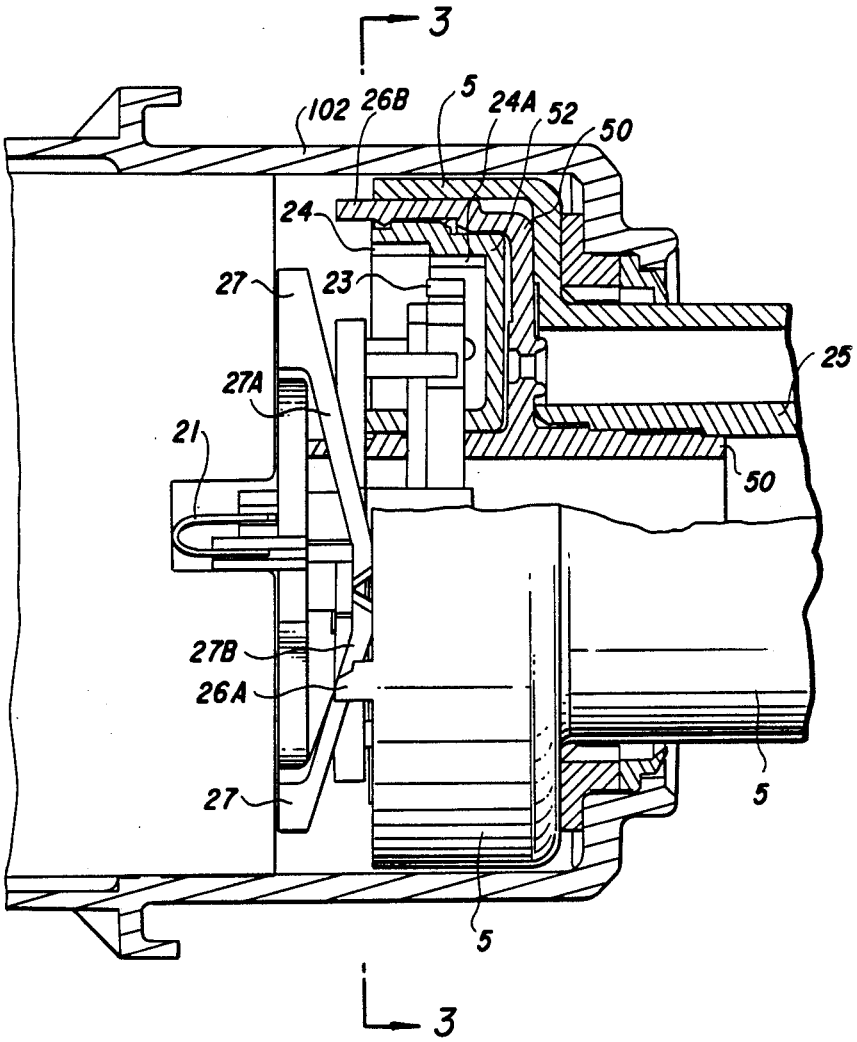
FIG. 2 is another side sectional view of the sprinkler head particularly showing the trip mechanism.
Figure 3:
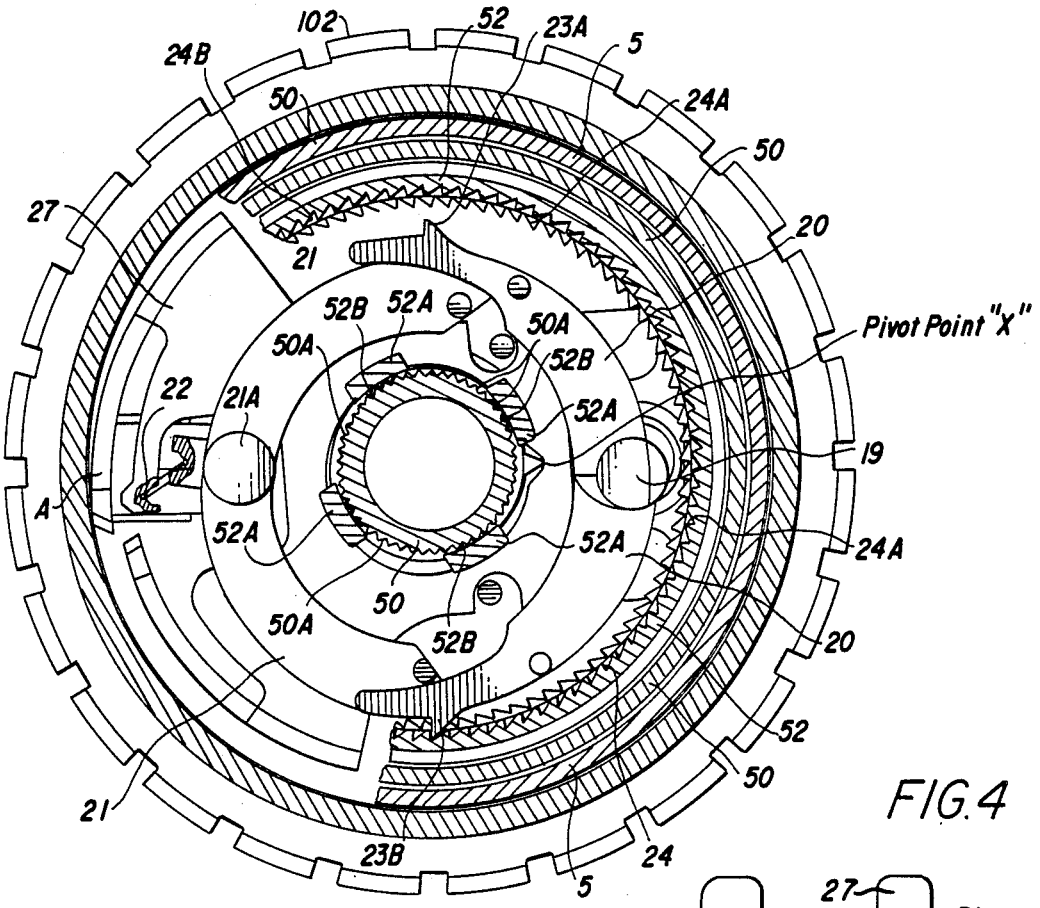
FIG. 3 is a cross-sectional view taken along the line 3—3 of FIG. 2.

Pawl 20, as shown in FIG. 2 is engaged by an arcuate follower 21 which is pivotally mounted on a shaft 21A. An over-center spring 22 causes the follower 21 to turn the follower in a first direction to force a projection 23A at one end of pawl 20 into engagement with a first set of saw teeth 24A formed on the bottom of the inner riser; or alternately to turn the pawl so that a tooth 23B at its other end engages a second set of teeth 24B on the end of the inner riser. The teeth 24A and 24B are oppositely directed, so that when the pawl 20 engages teeth 23A the poppet assembly is caused to turn in one direction, and when the pawl engages the teeth 23B the pop-up assembly is caused to turn in the opposite direction.

The teeth 24A and 24B are actually formed on the interior surface of a ring member 52 which is coupled to the inner riser assembly 25 through a tubular member 50. These elements actually form a protective clutch with the inner riser assembly 25 as is described in more detail in Copending application Ser. No. 07/334,326.

The follower 21 is moved angularly between its first and second positions by a shifter mechanism 27 which is pivotally mounted on the end of a gear box housing 120 (FIG. 1) at a pivot point X (FIG. 2). As best shown in FIG. 2, the outer riser 5 has a trip tab 26A protruding from its lower end, and the tubular member 50 attached to the inner riser assembly 25 has a trip tab 26B protruding from its inner end. The shifter mechanism 27 has a pair of ramped resilient fingers 27A and 27B. Finger 27A is engaged by tab 26A, for example, when the pop-up assembly reaches a particular limiting angular position; and resilient finger 27B is engaged by trip tab 26B when the poppet assembly is turned to its other limiting position.

When the trip tabs engage the resilient fingers of the shifting mechanism, they cause the shifting mechanism to move from one position to another causing the follower 21 to actuate the over-center spring 22, and thereby biasing the pawl assembly 20 from one position to another. The positions of the trip tabs 26A and 26B may be adjusted by controlling the relative angular positions of the inner riser assembly 25 and outer riser 5. This is achieved by rotating screw 32 (FIG. 1), as will be described in more detail in Copending application Ser. No. 07/339,203.

Figure 4:
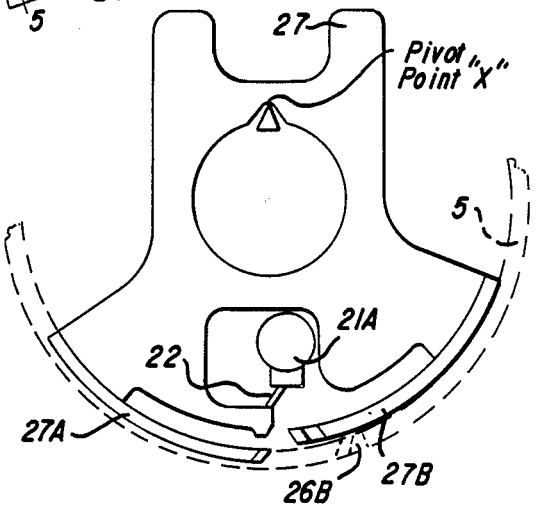
FIG. 4 is a schematic simplified view of the trip mechanism.
Figure 5:
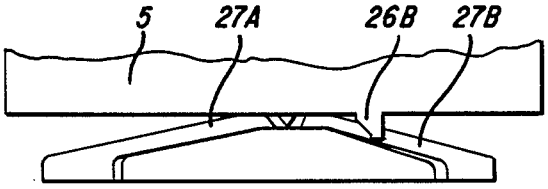
FIG. 5 is another schematic view of the trip mechanism taken from the bottom of FIG. 4.

In accordance with the present invention, the ramped fingers 27A and 27B of the shifter 27 are resilient, and, as best shown in FIGS. 4 and 5, when either the trip tab 26A or the trip tab 26B is forced against the corresponding resilient finger 27A or 27B of the shifter 27, instead of breaking off the trip tab, it forces the corresponding resilient finger 27A or 27B downwardly enabling the particular trip tab 26A, 26B to pass over the resilient finger. This action causes the shifter to reverse the direction of rotation of the pop-up assembly. However, the fingers 27A, 27B are ramped so that they do not shift the shifter on the return rotation of the pop-up assembly to its preset arc of travel. Accordingly, the reverse rotation of the pop-up assembly by the internal motor will cause the internal mechanism automatically to reset itself to its original arc of travel so that the sprinkler may continue to operate in accordance with its previous setting.

As shown in FIG. 4, the shifter 27 is pivoted about pivot point "X". This pivot action eliminates rubbing wear abrasion between running surfaces, and controls location by requiring only the points of retention.

It will be appreciated that while a particular embodiment of the invention has been shown and described, modifications may be made. It is intended in the claims to cover all modifications which come within the true spirit and scope of the invention.

I claim:

1. In a sprinkler head comprising a tubular housing, and an assembly rotatably mounted within the housing, the combination of: a drive member mounted in said housing and movable between first and second angular positions to cause said assembly to turn in said housing; a reversing mechanism mounted in said housing and movable between first and second positions to cause said drive member to rotate said assembly in one direction of the other; and at least one trip tab mounted on said assembly for engaging said reversing mechanism to move said reversing mechanism between its first and second positions so as to reverse the direction of rotation of said assembly, said reversing mechanism being shaped for rigid inflexible engagement with said trip tab immediately to initiate movement of said reversing mechanism between its first and second positions when said trip tab is moving in a first direction so as to reverse the direction of rotation of said assembly and said reversing mechanism being further shaped so that said trip tab passes said reversing mechanism without deflection of said trip tab or damage to said trip tab or to said reversing mechanism when said assembly is turned forcibly with respect to said housing so as to force the tab in a direction opposite the first direction.

2. The combination defined in claim 1, in which said tubular housing has an inlet at one end, said assembly is a pop-up assembly having a nozzle mounted on the end thereof, said pop-up assembly being mounted within the housing and movable longitudinally with respect to the housing from a retracted position within the housing to an operational position in which the pop-up assembly protrudes through an end of the housing opposite the one end thereof to enable the nozzle to discharge water over a sector of land to be irrigated in response to water introduced under pressure into the housing through the inlet.

3. The combination defined in claim 1, in which said reversing mechanism has at least one member positioned to be engaged by said trip tab to shift said reversing mechanism and to be depressed by said trip tab when the assembly is turned forceably in a first direction with respect to said housing, so that the tab passes over the resilient member, said resilient member being shaped so that said trip tab moves over said resilient member without shifting said reversing assembly when the pop-up assembly is turned in the opposite direction.

4. The combination defined in claim 1, and which includes first and second trip tabs mounted on said assembly for selectively moving said reversing mechanism to its first and second position.

5. The combination defined in claim 1, in which said reversing mechanism is pivotally mounted in said housing for pivotal movement about a pivot point to reduce friction and abrasion wear.

6. In a sprinkler head comprising a tubular housing, and an assembly rotatably mounted within the housing, the combination of: a drive member mounted in said housing and movable between first and second angular positions to cause said assembly to turn in said housing; a reversing mechanism mounted in said housing and movable between first and second positions to cause said drive member to rotate said assembly in one direction or the other; said reversing mechanism has at least one resilient member shaped as a ramp which allows deflection in the axial orientation; and at least one trip tab mounted on said assembly for engaging said resilient member where said resilient member is to shift said reversing mechanism between its first and second positions and to be depressed by said trip tab when the assembly is turned forcibly in a first direction with respect to said housing, so that the tab passes over the resilient member, said resilient member being shaped so that said trip tab moves over said resilient member without shifting said reversing mechanism when the pop-up assembly is turned in the opposite direction.

7. In a sprinkler head comprising a tubular housing, and an assembly rotatably mounted within the housing, the combination of: a drive member mounted in said housing and movable between first and second angular positions to cause said assembly to turn in said housing; a reversing mechanism mounted in said housing and movable between first and second positions to cause said drive member to rotate said assembly in one direction or the other; first and second trip tabs mounted on said assembly for selectively moving said reversing mechanism to its first and second positions; and said reversing mechanism has first and second resilient fingers to be respectively engaged by said first and second trip tabs to shift said reversing mechanism and to be depressed thereby when said assembly is turned forcibly with respect to said housing, said fingers being ramp shaped so that the tabs pass over the fingers without shifting said reversing assembly upon subsequent reverse rotation of said assembly.

* * * * *